US007827972B2

(12) United States Patent
Makino

(10) Patent No.: US 7,827,972 B2
(45) Date of Patent: Nov. 9, 2010

(54) APPARATUS FOR CONTROLLING INTERNAL PRESSURE OF FUEL TANK

(75) Inventor: Katsuhiko Makino, Aichi-ken (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 0 days.

(21) Appl. No.: 12/172,499

(22) Filed: Jul. 14, 2008

(65) Prior Publication Data

US 2009/0031997 A1 Feb. 5, 2009

(30) Foreign Application Priority Data

Aug. 2, 2007 (JP) ..... 2007-201789

(51) Int. Cl.
*F02M 33/02* (2006.01)

(52) U.S. Cl. ..... 123/518; 123/519; 123/520; 95/146; 96/113; 96/116

(58) Field of Classification Search ..... 123/518, 123/519, 520; 95/143, 146; 96/108, 113, 96/116

See application file for complete search history.

(56) References Cited

U.S. PATENT DOCUMENTS 3,740,928 A * 6/1973 Schmid ..... 96/113
5,021,071 A * 6/1991 Reddy ..... 95/106
5,431,144 A 7/1995 Hydo et al.
2002/0148354 A1* 10/2002 Amano et al. ..... 96/112
2003/0226596 A1* 12/2003 Bolle et al. ..... 137/587
2005/0241377 A1* 11/2005 Takahashi et al. ..... 73/118.1

FOREIGN PATENT DOCUMENTS

JP 5864854 5/1983
JP 6074118 3/1994

* cited by examiner

*Primary Examiner*—Stephen K Cronin
*Assistant Examiner*—Anthony L Bacon
(74) *Attorney, Agent, or Firm*—Dennison, Schultz & MacDonald

(57) ABSTRACT

An adsorption/desorption device is communicated with an upper space of a fuel tank via a vapor passage. The adsorption/desorption device is configured to selectively adsorb or desorb air components contained in vapor. The adsorption/desorption device and the vapor passage are not communicated to the external atmosphere. The fuel tank is provided with a pressure detecting device for detecting the internal pressure of the fuel tank. A pressure regulating device is provided to the vapor passage for controlling and maintaining the pressure applied to the adsorption/desorption device. When the internal pressure of the fuel tank is higher than the atmospheric pressure, the internal pressure of the fuel tank is pressure-fed to the side of the adsorption/desorption device via the pressure regulating device until the internal pressure of the fuel tank becomes in equilibrium with the atmospheric pressure. When the internal pressure of the fuel tank is lower than the atmospheric pressure, vapor is pressure-fed to the side of the fuel tank via the pressure regulating device until the internal pressure of the fuel tank becomes in equilibrium with the atmospheric pressure.

6 Claims, 3 Drawing Sheets

APPARATUS FOR CONTROLLING INTERNAL PRESSURE OF FUEL TANK

This application claims priority to Japanese patent application serial number 2007-201789, the contents of which are incorporated herein by reference.

BACKGROUND OF THE INVENTION

1. Field of the Invention

The present invention relates to an apparatus for controlling a change of the internal pressure of a fuel tank caused by evaporation of a liquid fuel that is stored within the fuel tank. More particularly, it relates to an apparatus for controlling internal pressure in a fuel tank that prevents fuel components from escaping out of the fuel tank.

2. Description of the Related Art

Liquid fuel such as gasoline may be store in a fuel tank. When a gaseous layer space is formed in an upper portion within the fuel tank as am amount of the liquid fuel within the fuel tank is reduced, vapor generated (due to the evaporation of the liquid fuel such as evaporated fuel) may be filled in an upper space within the fuel tank. In addition to fuel components, air components are also contained in the vapor. Therefore, when a vehicle is exposed to heat over a long period of time and a temperature within the fuel tank is increased because of a high ambient temperature, the liquid fuel begins actively to evaporate. Consequently, an internal pressure within the fuel tank is increased caused by the expansion of vapor that may cause a damage of the fuel tank. In order to avoid the damage of the fuel tank, it is necessary to exhaust the vapor within the fuel tank to outside in accordance with the internal pressure within the fuel tank. However, it may cause a waste of fuel if the fuel components are escaped as the air components are exhausted. In order to prevent a waste of fuel, conventionally an apparatus for controlling a change of internal pressure within a fuel tank is known as disclosed in Japanese Laid Open Utility Model Publication No. 58-64854. According to such a conventional apparatus, vapor within a fuel tank may be exhausted via a canister containing a porous material, such as an activated carbon in order to control a change of internal pressure within a fuel tank. The fuel components may be captured by the porous materials as the vapor within the fuel tank passes through the canister so that only air components can be exhausted to the external atmosphere. Further, the canister communicates with an intake pipe of an engine and is constructed to supply fuel components into an engine. The fuel components captured by the porous material of the canister are desorbed (purged) due to a negative pressure in an intake pipe that is generated when the engine is started, and are then supplied into the engine.

In order to recover an ability of the canister to capture fuel components, it is necessary to sufficiently desorb captured fuel components. Generally, it is known that a required amount of desorbed air is 300 to 600 times more than a capacity of a canister. Therefore, an amount of desorption and time for desorption depend on a capacity of a canister. However, the recent hybridization of vehicles and the economy run technology have caused an increase of an engine stop time during driving. Also, negative pressure in an intake pipe has been reduced due to a loss reduction technology of a pump for an engine. Because of these factors, it is hardly to obtain a sufficient time for desorption using the configuration as disclosed in Japanese Laid-Open Utility Model Publication No. 58-64854.

Japanese Laid-Open Patent Publication No. 6-74118 discloses an apparatus having a fuel vapor separator mounted on an upper portion of a fuel tank. The fuel vapor separator is filled with porous materials, such as zeolite that permits the passage of air components but does not permit the passage of fuel components. The vapor within the fuel tank can be exhausted via a canister as well as the fuel vapor separator to the atmosphere. This construction can only exhaust air components out of the fuel tank in accordance with the internal pressure while the capacity of the canister is maintained at a low level. Because the capacity of the canister can be maintained at a low level, the time consumed for purging fuel components may be saved. When the internal pressure of the fuel tank is reduced to lower than the atmospheric pressure, external air is introduced into the fuel tank via the fuel vapor separator.

The fuel vapor separator according to the Japanese Laid-Open Patent Publication No. 6-74118 utilizes a porous material having a pores diameter of approximately 3.5 to 4.0 angstroms that permits the passage of air components but does not permit the passage of fuel components. However, diameters of pores of the porous materials are not uniform. Therefore, it is usual that some pores may have a size that permits the passage of the fuel components. Accordingly, the evaporated fuel control apparatus as disclosed in Japanese Laid-Open Patent Publication No. 6-74118, which exhausts vapor within the fuel tank to the atmosphere via the fuel vapor separator may permit the passage of the fuel components out of the fuel tank depending on the capability of the fuel vapor separator. Consequently, it cannot reliably avoid a loss of fuel.

Thus, in view of the above-described problems, the present invention has found that the loss of fuel components may be prevented if a change of internal pressure could be controlled by a porous material, which is not communicated with external air instead of selectively exhausting vapor within the fuel tank. It is therefore an object of the present invention to provide an apparatus for controlling internal pressure of a fuel tank that prevents fuel components from escaping out of the fuel tank without, being influenced by the engine condition, as the internal pressure within the fuel tank changes.

SUMMARY OF THE INVENTION

One aspect according to the present invention includes an apparatus for controlling internal pressure of a fuel tank. The apparatus includes an adsorption/desorption device for selectively adsorbing and/or desorbing air components contained in vapor that is communicated to an upper space within a fuel tank via a vapor passage. The adsorption/desorption device and the vapor passage are not communicated with the external air. More particularly, a fuel tank of the present invention can control internal pressure of the fuel tank by utilizing an adsorption/desorption device for capturing air components within vapor that is not communicated with the atmosphere, instead of using an evaporated fuel control apparatus that is communicated with an external atmosphere as disclosed in Japanese Laid-Open Patent Publication No. 6-74118. The adsorption/desorption device may be provided at an end of a vapor passage to form a cul-de-sac or may be provided in the middle of the vapor passage formed as a circulation channel to allow vapor flow through the vapor passage. If the temperature and the internal pressure within the fuel tank are increased, vapor containing a mixture of fuel components and air components that is filled in an upper space within the fuel tank may escape toward the adsorption/desorption device via the vapor passage due to the increased internal pressure. As the vapor volume is reduced while the air components within the vapor is adsorbed in the adsorption/desorption device, the increased internal pressure within the fuel tank is reduced. The air components mainly consist of nitrogen and oxygen.

The fuel tank is provided with a pressure detecting device for detecting an internal pressure of the fuel tank. A pressure regulating device for controlling and maintaining the pressure applied to the adsorption/desorption device is provided in the vapor passage between the fuel tank and the adsorption/desorption device.

When the pressure detecting device detects that the internal pressure of the fuel tank is higher than the atmospheric pressure, vapor is pressure-fed from the fuel tank to the adsorption/desorption device via the pressure detecting device until the internal pressure of the fuel tank is in equilibrium with the atmospheric pressure. The internal pressure of the fuel increases or reduces depending on the temperature and the vapor pressure. When the internal pressure (vapor pressure) is increased as the temperature within the fuel tank raises, a part of air components contained in vapor and having pressure (volume) that exceeds the atmospheric pressure, is adsorbed via the adsorption/desorption device. Conversely, when the internal pressure (vapor pressure) is decreased as the temperature within the fuel tank reduces, a part of the air components contained in the vapor and having a pressure (volume) less thin the atmospheric pressure is desorbed via the adsorption/desorption device. According, to the present invention, as described-above, vapor is adsorbed or desorbed in accordance with the change of the pressure (vapor pressure) corresponding to the change of the temperature, and control the pressure by so-called pressure swing adsorption process (PSA).

Preferably, the vapor passage may be configured as a circulation channel such that the vapor within the fuel tank is introduced from one communication opening into the adsorption/desorption device. The vapor that has passed through the adsorption/desorption device, is then returned into the fuel tank from the other communication opening. In this case, the adsorption/desorption device is provided in the middle of the vapor passage that is configured as a circulation channel so that the vapor can pass through the adsorption/desorption device.

Preferably, a pressure regulating valve may be provided in the vapor passage on the opposite side to a pressure regulating device with respect to the adsorption/desorption device.

Further, a temperature regulating device for controlling temperature within the adsorption/desorption device may be provided to the adsorption/desorption device. When the adsorption/desorption device adsorbs air components in the vapor, the inside of the adsorption/desorption device may be cooled by the temperature regulating device, while the inside of the adsorption/desorption device is heated by the temperature regulating device as the adsorption/desorption device desorbs air components included in the vapor.

More preferably, a temperature detecting device may be provided to at least one of the fuel tank, the adsorption/desorption device and the vapor passage for detecting internal temperature. The temperature detecting device may be used for detecting temperature of a fluid fuel (fluid layer) or of an upper space (gaseous layer) in the fuel tank, if the temperature detecting device is provided to the fuel tank.

According to the present invention, although the internal pressure of the fuel tank is increased, a volume of vapor may be reduced by the adsorption/desorption device because an adsorption/desorption device is provided that communicates with the upper space in the fuel tank. Therefore, it is possible to avoid a damage of the fuel tank as the internal pressure increases. Further, since the adsorption/desorption device and the vapor passage for controlling the change of the internal pressure of the fuel tank are not communicated with the external air, fuel components may not escape to the external atmosphere together with the air components as the internal pressure of the tank increases. Air components within the vapor are selectively adsorbed in the adsorption/desorption device so that a concentration of the fuel components contained in the vapor may increase. As a result, the fuel components may be effectively liquefied when the temperature in the fuel tank is reduced.

Vapor can reliably move between the fuel tank and the adsorption/desorption device by providing a pressure regulating device in the vapor passage. Further, it is possible to reliably respond to the change of pressure in the fuel tank providing a pressure detecting device to the fuel tank.

If the internal pressure of the fuel tank is controlled to always be in equilibrium with the atmospheric pressure, a load to be applied to the fuel tank due to the difference between the internal and the external pressure may be reduced. Therefore, the fuel tank can be made of resin so that the size and weight as well as cost can be reduced. Further, because the internal pressure of the fuel tank is controlled by selectively increasing or decreasing the air components by means of PSA, it is possible to reduce the loss of the liquefied and/or evaporated fuel components.

If a vapor passage is configured as a circulation channel to allow vapor to pass through the adsorption/desorption device, adsorption and desorption speed of fuel components can be accelerated. As a result, a load applied to the fuel tank can be reduced.

A pressure within the adsorption/desorption device can be maintained at a predetermined level by providing with a pressure regulating valve.

The adsorption/desorption device includes a feature such that the adsorption ability increases at low temperature and decreases at high temperature. Therefore, a temperature regulating device can be provided for controlling the temperature within the adsorption/desorption device for effective adsorption and desorption. Air components can be adsorbed more effectively and rapidly, if the adsorption ability is increased by cooling the adsorption/desorption device when air components within vapor are adsorbed. Conversely, when air components captured in the adsorption/desorption device are desorbed, the adsorption ability can be reduced by heating the adsorption/desorption device so that the air components are forced to be desorbed. Consequently, air components can be more effectively and rapidly desorbed compared with desorption utilizing only negative pressure.

An exact PSA can be achieved by providing a temperature detecting device to a fuel tank, an adsorption/desorption device or a vapor passage. Because the pressure regulating device and/or the temperature regulating device may be controlled based on the pressure swing adsorption process while the temperature within the fuel tank and/or the adsorption/desorption device is detected, it is possible to improve the accuracy of the internal pressure control.

BRIEF DESCRIPTION THE DRAWINGS

DETAILED DESCRIPTION OF THE INVENTION

Each of the additional features and teachings disclosed above and below may be utilized separately or in conjunction with other features and teachings to provide an improved apparatus for controlling an internal pressure of a fuel tank. Representative examples of the present invention, which utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

First Embodiment

Figure 1:
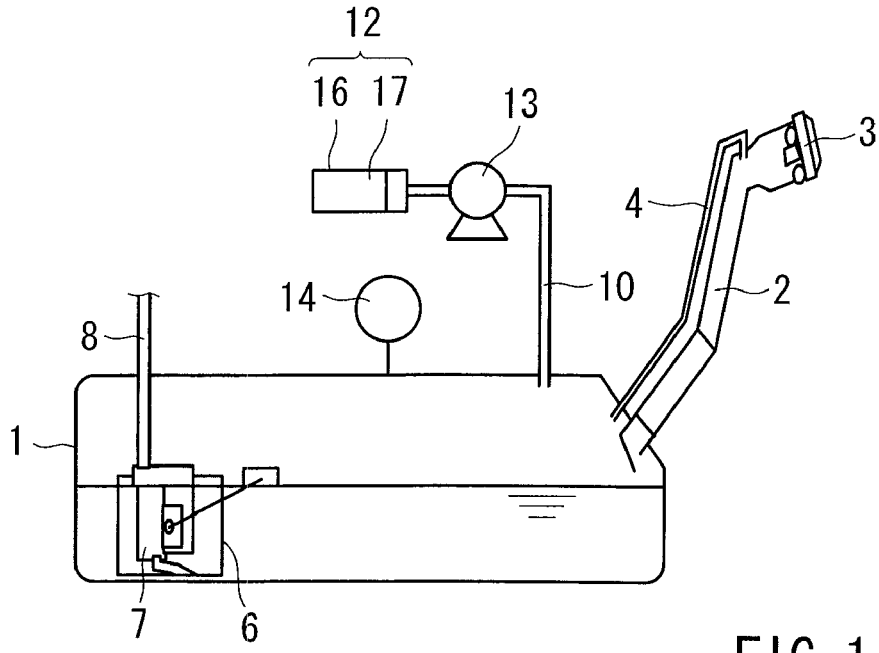
FIG. 1 is a schematic view of an apparatus for controlling an internal pressure of a fuel tank according to a first representative embodiment.

A first representative embodiment will now be described with reference to FIG. 1. As shown in FIG. 1, a fuel tank 1 is generally a hollow container for storing a liquid fuel such as gasoline and a fuel supply passage 2 communicates within the fuel tank 1 via a side wall of the fuel tank 1. An end of the fuel supply passage 2 is open to the external atmosphere and is configured as an fuel filler port for inserting an fuel filling device (not shown) when filling fuel. The fuel filler port is sealed with a cap 3 except when fuel is filled. A vent pipe 4 is provided so that the fuel can be smoothly supplied. A sub-tank 6 is arranged within the fuel tank 1 and a pump unit 7 is arranged within the sub-tank 6. A fuel supply passage 8 communicating to an engine (not shown) is connected to the pump unit 7. Fuel saved in the sub-tank 6 is pressure-fed by the pump unit 7 to an engine via the fuel supply passage 8.

The fuel tank 1 communicates with a vapor passage 10, which communicates with the upper space (gaseous layer) of the fuel tank 1. An end of the vapor passage 10 is connected to an adsorption/desorption device 12 that selectively adsorbs or desorbs only air components within vapor but not fuel components. A pressure regulating device 13 for controlling and maintaining the pressure applied to the adsorption/desorption device 12 is provided in the vapor passage 10 and is disposed between the fuel tank 1 and the adsorption/desorption device 12. A pressure regulating device 14 (hereinafter also called "pressure sensor 14") for detecting internal pressure of the fuel tank 1 is attached to a top wall of the fuel tank 1. The adsorption/desorption device 12 is constructed with a hollow container 16 and a porous material 17 arranged in the hollow container 16. Air components within vapor are selectively adsorbed or desorbed by the porous material 17. As shown in FIG. 1, the vapor passage 10 and the adsorption/desorption device 12 (the hollow container 16 thereof) do not communicate with the external atmosphere, except through the fuel supply passage 2 by removing the cap 3 for supplying fuel, so that the space within the fuel tank 1 is sealed. The fuel tank 1 of the first representative embodiment does not communicate with a canister and has no passage that directly communicates with the space within the fuel tank 1 except vapor passage 10 and the fuel supply passage 2. More specifically, according to the first representative embodiment, the change of the internal pressure of the fuel tank can be controlled without utilizing a known canister. Since it is not necessary to incorporate a canister, the number of items and a cost as well as a size of the apparatus can be reduced.

A known pump used for gaseous fluid may be used as a pressure regulating device 13 (hereinafter also called "pump" 13") that can pressure-feed gas (vapor) in dual directions and a known pressure sensor may be used as a pressure detecting device 14. Porous material 17 can be any material having pores, which can selectively adsorb or desorb air components within vapor, and may be used without any particular limitations. Resins such as aluminosilicate-based zeolite and polyimide; molecular sieving carbon obtained from coal; and zeolite-type compound can be used for the porous material 17. Zeolite-type compound can include phosphoric salt, aluminoarsenate and germanate. Air components mainly consist of nitrogen and oxygen. According to some literatures, the diameter of nitrogen molecules may be approximately 3.6 to 4.0 angstroms and a diameter of oxygen molecules may be approximately 3.4 to 3.8 angstroms. Even butane molecules ($C_4H_{12}$), that have the smallest size in a various fuel components, may have a diameter of approximately 4.2 to 5.0 angstroms. Therefore, porous materials having a pore diameter of approximately 3.0 to 4.0 angstroms may be used as porous materials 17 so that air components within vapor can be selectively adsorbed or desorbed. Because pore diameters of some porous materials 17 are not always uniform and a diameter of parts of molecular sieving carbon may be larger in an area proximal to their openings, a part of fuel components may be slightly adsorbed when air components within vapor are adsorbed. The concept of the present invention does not exclude an adsorption of fuel components completely but a part of the fuel components may be slightly adsorbed when the air components are selectively adsorbed.

Figure 2:
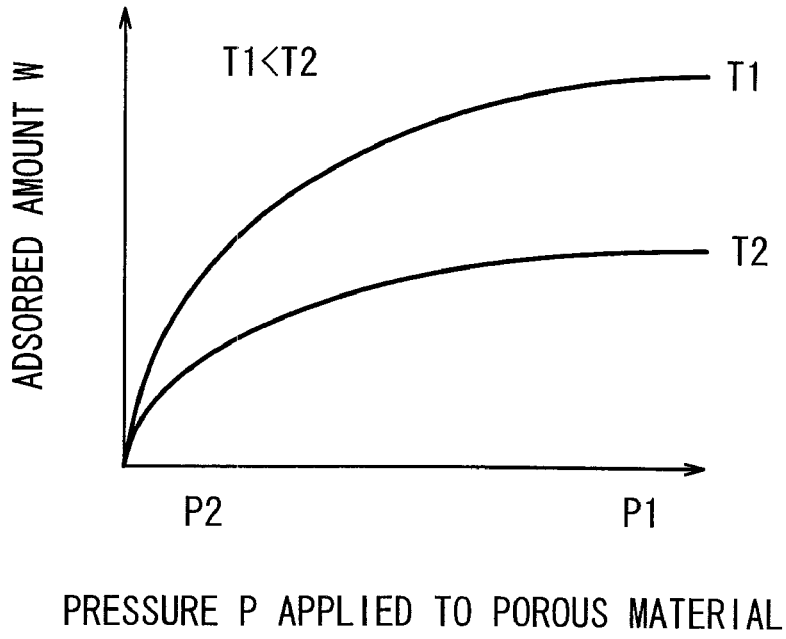
FIG. 2 is a chart showing a pressure swing characteristic of a porous material.

FIG. 2 shows an adsorption characteristics of the porous material 17. As shown in FIG. 2, the porous material 17 has characteristics such that an adsorption amount increases as a pressure applied to the porous material 17 increases regardless of temperature (improvement of an adsorption ability). Since the inside of the fuel tank 1 is configured as a sealed space, when the internal pressure of the fuel tank 1 is increased, vapor automatically escapes to an adsorption/desorption device 12. Due to the increased internal pressure, mainly air components within vapor are adsorbed by the porous material 17. Conversely, when the internal pressure of the fuel tank 1 reduces, vapor moves toward the fuel tank 1 due to the negative pressure condition developed in the fuel tank 1 so that air components are desorbed from the porous material 17. It may be possible to control a change of the internal pressure of the fuel tank 1 by providing the adsorption/desorption device 12 that communicates with the fuel tank 1 via the vapor passage 10 because the inside of the fuel tank 1 is configured as a sealed space. In addition, according to the first representative embodiment, a pump 13 is provided in the middle of the vapor passage 10 so that the vapor can move while the internal pressure of the fuel tank 1 is effectively controlled. If the air components within vapor must be adsorbed to the porous material 17, the pump 13 pressure-feeds the vapor to the side of the adsorption/desorption device 12. On the contrary, if the air components within the vapor must be desorbed from the porous material 17, the pump 13 is controlled such that the vapor is pressure-fed to the side of the fuel tank 1. As described above, according to the first representative embodiment, the internal pressure of the fuel tank 1 is controlled by the PSA (pressure swing adsorption process) using the pressure swing characteristics (adsorption ability) of the porous material 17.

Figure 3:
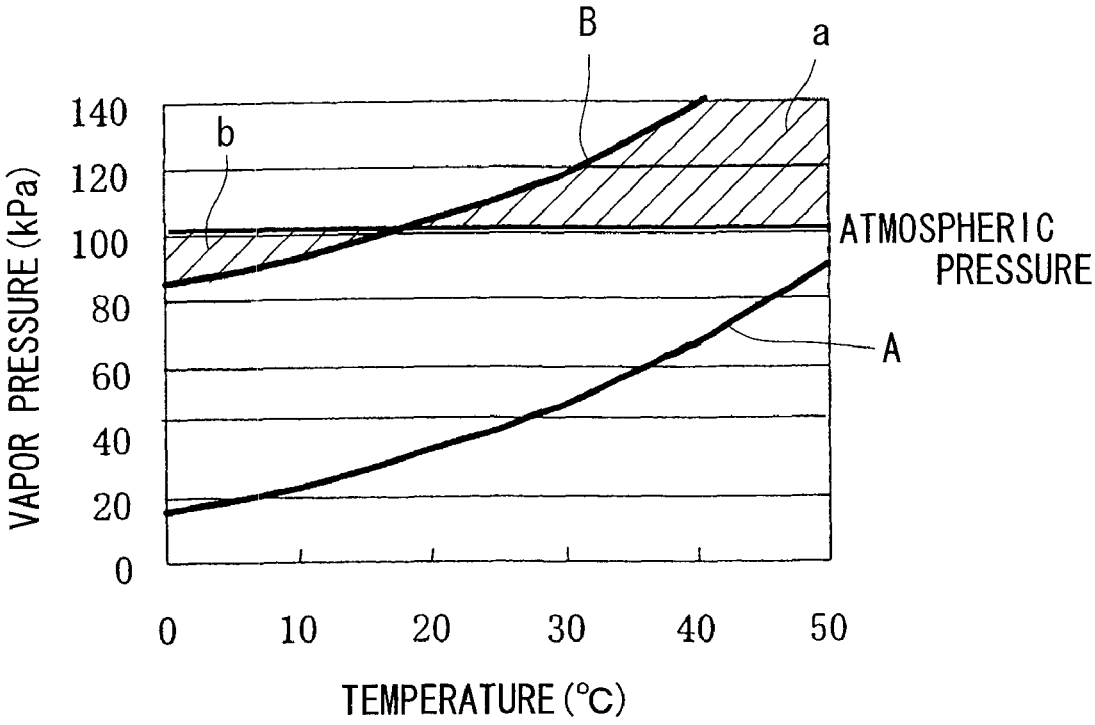
FIG. 3 is a chart showing a pressure curve of a vapor within a fuel tank.

FIG. 3 shows a vapor pressure curve showing the vapor pressure within the fuel tank 1 as a basis for a pressure feed amount. A curve A shows a vapor pressure of gasoline (fuel) and a curve B shows a vapor pressure of a mixture of gasoline and air, when the fuel tank 1 is sealed, i.e. an internal pressure of the fuel tank 1. According to FIG. 3, when the temperature within the fuel tank 1 is slightly below 20° C. (about 18° C.), the internal pressure of the fuel tank 1 is in equilibrium with the atmospheric pressure. On the contrary, when the temperature within the fuel tank 1 is less than about 18° C., the internal pressure of the fuel tank 1 is lower than the atmospheric pressure. Therefore, a load due to the external pressure may be applied to the fuel tank 1. When the temperate within the fuel tank 1 exceeds about 18° C., the internal pressure of the fuel tank 1 is higher than the atmospheric pressure. Therefore, a load due to the internal pressure may be applied to the fuel tank 1. For this reason, the first representative embodiment incorporates the pressure sensor 14 described previously for detecting a pressure within the fuel tank 1. If the pressure sensor 14 detects that the internal pressure of the fuel tank 1 is higher than the atmospheric pressure, vapor is pressure-fed to the side of the adsorption/desorption device 12 by means of the pump 13 until the internal pressure becomes in equilibrium with atmospheric pressure. The pump 13 stops when the internal pressure of the fuel tank 1 reaches the same level as the atmospheric pressure. At this time, the pressure within the adsorption/desorption device 12 is maintained higher than the pressure within the fuel tank 1 by the pump 13. If the pressure sensor 14 detects that the internal pressure of the fuel tank 1 is lower than the atmospheric pressure, vapor is pressure-fed to the fuel tank 1 side by means of the pump 13 until the internal pressure becomes in equilibrium with atmospheric pressure. The pump 13 stops when the internal pressure of the fuel tank 1 reaches the same level as the atmospheric pressure. At this time as well, the pressure within the adsorption/desorption device 12 is maintained by the pump 13. Accordingly, it is controlled such that a part of the air components corresponding to a region a as shown in FIG. 3 is adsorbed to the porous material 17 and a part of the air components corresponding to a region b is desorbed from the porous material 17. As a result, a load can be avoided that may be applied to the fuel tank 1 due to the difference between the internal and external pressures. Therefore, the fuel tank 1 can be made of, for example, resin. A vapor pressure of gasoline reaches the same level as an atmospheric pressure at the temperature of about 55° C. A capacity of fine pores of the porous material 17 is selected so that the porous material 17 can adsorb at least a part of the air components contained in the region a in FIG. 3, i.e., a part of the air components that exceeds atmospheric pressure when the vapor pressure of gasoline reaches the same level as the atmospheric pressure. Further, an operational direction and a start/stop timing of the pump 13 based on the pressure sensor 14 is regulated by a controller (not shown).

Second Embodiment

Figure 4:
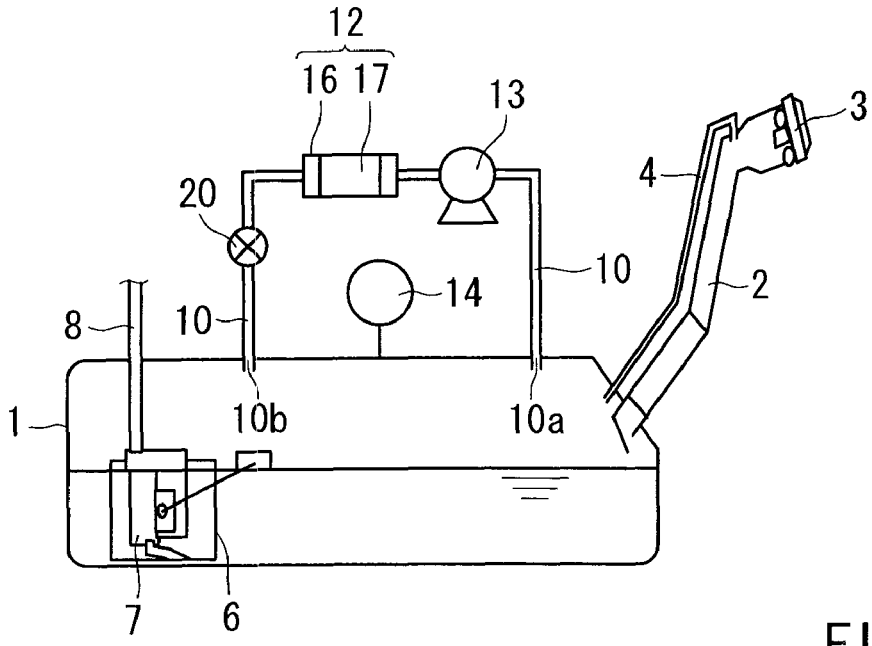
FIG. 4 is a schematic view of an apparatus for controlling an internal pressure of a fuel tank according to a second representative embodiment.

A second representative embodiment according to the present invention will be described with reference to FIG. 4. The second representative embodiment is a modification of the first representative embodiment and is different from the first embodiment in that the vapor passage 10 is configured as a circulation channel and the adsorption/desorption device 12 provided in the middle of the vapor passage 10 to allow vapor flow through the inside of the adsorption/desorption device 12 as shown in FIG. 4. The vapor passage 10 has openings 10*a* and 10*b* that communicate with an inner space of the fuel tank 1. Vapor within the fuel tank 1 is introduced from opening 10*a* of the vapor passage 10 and then returned into the fuel tank 1 via opening 10*b* of the vapor passage 10. The air components are adsorbed to or desorbed from the porous material 17 and the vapor flows in opposite directions for adsorption and desorption. Therefore, because the adsorption/desorption device 12 is provided to allow vapor flow through the inside, it is possible to improve the speed for adsorbing or desorbing air components and control the internal pressure of the fuel tank 1 to be in equilibrium with the atmospheric pressure in a highly responsive manner. The adsorption/desorption device 12 is configured as a module for allowing fuel components with a larger molecule diameter than a fine pore diameter of the porous material 17 to pass through the adsorption/desorption device 12. The configurations of modules are not limited as long as fuel components can pass through the adsorption/desorption device 12 while air components within vapor are adsorbed. For example, various modules can be used such as a tubular module having a multiple of tubular porous materials 17 arranged within the container 16, a hollow fiber module having porous materials 17 as hollow fiber membranes that are laminated in multiple layers within the container 16, a pleated module having a porous material 17 formed as a pleated membrane that is peripherally arranged within the container 16, or a spiral module having a multiple of porous materials 17 formed as flat membranes that are circlingly arranged in the container 16 at a distance from each other by means of spacers. Further, the porous material 17 may be configured as a single member that has a slightly smaller size than an inner size of the container 16.

Because the vapor passage 10 is configured as a circulation channel, pressure within the adsorption/desorption device 12 may be difficult to be maintained only by means of the pump 13. The second representative embodiment is different from the first representative embodiment in that a pressure regulating valve 20 is provided in the vapor passage 10 on the opposite side to the pump 13 with respect to the adsorption/desorption device 12. The pressure regulating valve 20 is a diaphragm valve that operates to open and close at a predetermined pressure (pressure regulating value) and is biased in a closing direction of the valve. The pressure within the adsorption/desorption device 12 is always maintained at a certain pressure level by means of the pressure regulating valve 20.

More specifically, when air components within vapor must be adsorbed to the porous material 17 as the internal pressure of the fuel tank 1 increases, the vapor is pressure-fed from the fuel tank 1 to the adsorption/desorption device 12 by the pump 13. If a pressure exceeding the pressure regulating value is applied to the pressure regulating valve 20, the pressure regulating valve 20 is opened against biasing force of the diaphragm allowing vapor to circulate in the vapor passage 10. When the internal pressure of the fuel tank 1 reaches the same level as the atmospheric pressure, the pump 13 stops so that pressure over the pressure regulating value may not be applied to the pressure regulating valve 20 any more. As a result, the pressure regulating valve 20 is closed due to the biasing force of the diaphragm so that the inside of the adsorption/desorption device 12 can be maintained at the certain high pressure (regulated pressure) level. Conversely, when the internal pressure of the fuel tank 1 is reduced and the air components are to be desorbed from the porous material 17, vapor is pressure-fed from the adsorption/desorption device 12 to the fuel tank 1 by means of the pump 13. At this time, if a negative pressure below the pressure regulating value is applied to the pressure regulating valve 20, the pressure regulating valve 20 is opened against the biasing force of the diaphragm allowing the vapor to circulate within the vapor passage 10. The pump 13 is stopped when the internal pressure of the fuel tank 1 reaches the same level as the atmospheric pressure. As a result, the negative pressure below the pressure regulating value is stopped from being applied to the pressure regulating valve 20 so that the pressure regulating valve 20 is closed due to the biasing force of the diaphragm. Therefore, the inside of the adsorption/desorption device 12 may be maintained at a certain negative pressure (regulated pressure) level. According to the second representative embodiment, the pressure regulating value is determined at 30 kPa.

Third Embodiment

Figure 5:
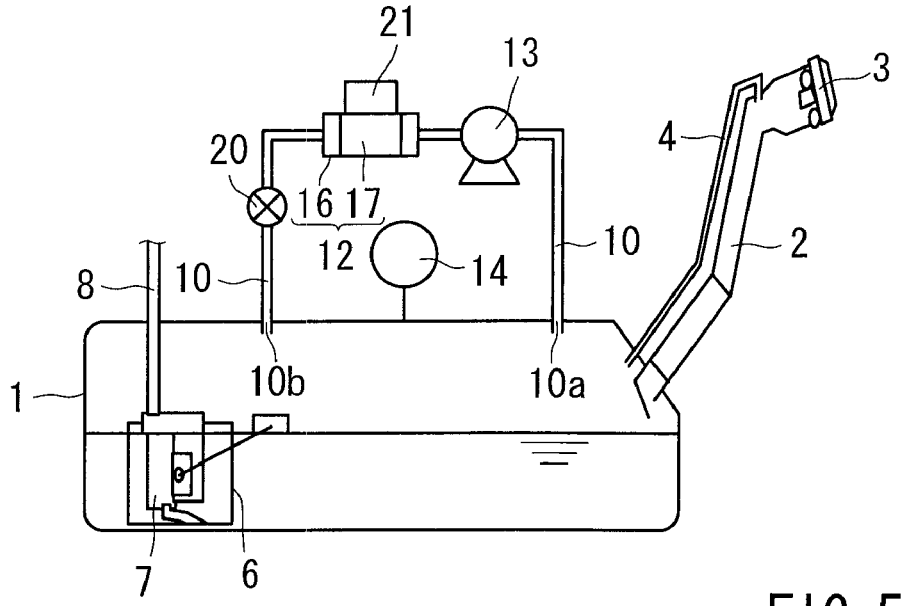
FIG. 5 is a schematic view of an apparatus for controlling an internal pressure of a fuel tank according to a third representative embodiment.
Figure 6:
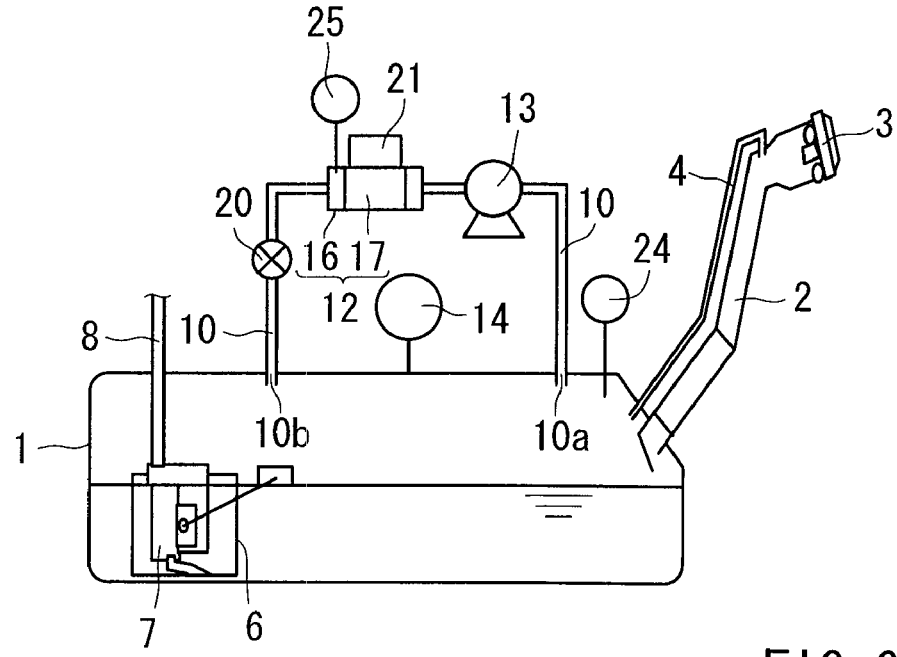
FIG. 6 is a schematic view of an apparatus for controlling an internal pressure of a fuel tank according to a fourth representative embodiment.

A third representative embodiment according to the present invention will be described with reference to FIG. 5. The third representative embodiment is a modification of the second representative embodiment that is different from the second embodiment in that a temperature regulating device 21 for regulating an internal temperature of the absorption/desorption device 12 is provided as shown in FIG. 5. As shown in FIG. 2, an adsorbed amount by a porous material 17 is reduced when the temperature is high (see T2), and is increased when the temperature is low (see T1). Therefore, according to the third representative embodiment, the inside of the adsorption/desorption device 12 is cooled by the temperature regulating device 21 when the air components within vapor are adsorbed by the adsorption/desorption device 12 and the inside of the adsorption/desorption device 12 is heated by the temperature regulating device 21 when the captured air components are desorbed from the adsorption/desorption device 12.

A heating and/or cooling level is not limited as long as the temperature varies within a range that does not exert an adverse effect upon the porous material 17 and/or vapor. However, in view of energy efficiency, the temperature may vary within the range of ±10° C. from the internal temperature of the adsorption/desorption device 12 so that the adsorbing characteristics of the porous material 17 can be effectively used. The temperature regulating device may have various configurations and are not limited to the illustrated embodiments as long as the temperature can be regulated in this way. A know heater and/or cooler may be used as a temperature regulating device and may include a PTC heater serving as a heater and/or a peltier element serving as a cooler. Operational timing of the heater and the cooler and/or temperature may be regulated by a (not shown) controller. Accordingly, it is possible to reduce a size of the porous material 17 and therefore, a size of the adsorption/desorption device 12 because the adsorbing characteristics of the porous material 17 can be improved by changing the temperature.

Fourth Embodiment

A fourth representative embodiment according to the present invention will be described with reference to FIG. 4. The fourth representative embodiment is a modification of the third representative embodiment and has temperature detecting devices 24 and 25 provided to the fuel tank 1 and the adsorption/desorption device 12, respectively, for detecting an internal temperature of the fuel tank 1 and the adsorption/desorption device 12. Various temperature sensors may be used as the temperature detecting device and the detected data can be delivered to a controller. A memory is installed in the controller. Pressure swing characteristics of the porous material 17 as shown in FIG. 2 and/or a vapor pressure curve showing a vapor pressure within the fuel tank 1 as shown in FIG. 3 are stored in the memory in advance. When a pressure sensor 14 detects that the internal pressure of the fuel tank 1 exceeds atmospheric pressure, the internal pressure of the adsorption/desorption device 12 is controlled to high-pressure level as shown by P1 by means of the pump 13 and the pressure regulating valve 20 so that (the porous member 17 of) the adsorption/desorption device 12 may capture air components within the vapor. At the same time, if the internal temperature of the fuel tank 1 as detected by the temperature sensor 24 is at a high level as shown by a curve T2, the adsorption/desorption device 12 may be cooled by means of the temperature regulating device 21 while the internal temperature within the adsorption/desorption device 12 is maintained at a low level as shown by a curve T1 by the temperature sensor 25. As a result, the internal pressure of the fuel tank 1 can be immediately controlled by improving the ability to adsorb the air components while the temperature and the pressure applied to the porous material 17 is accurately controlled based on the PSA. Conversely, when the pressure sensor 14 detects that the internal pressure of the fuel tank 1 is less than atmospheric pressure, the pressure within the adsorption/desorption device 12 is controlled to be a low-pressure level as shown by P2 by means of the pump 13 and the pressure relating valve 20 so that the air components within the vapor can be desorbed from (the porous material 17 of) the adsorption/desorption device 12. At the same time, if the internal pressure of the fuel tank 1 (detected by the temperature sensor 24) is at the low level as shown by the curve T1, the adsorption/desorption device 12 may be heated by means of the temperature regulating device 12 while the internal temperature within the adsorption/desorption device 12 is controlled to be at the high level as shown by a curve T2 by means of the temperature sensor 25. Accordingly, the internal pressure of the fuel tank 1 can be immediately controlled by reducing the ability to adsorb the air components (improving the ability to desorb the air components) while the temperature and the pressure applied to the porous material 17 is accurately controlled based on the PSA. A method for controlling the pump 13 and the pressure regulating valve 20 based on the detected data of the pressure sensor 14 has not been described in the second and the third representative embodiments, however, a method for doing such is the same as the fourth representative embodiment

Other Possible Modifications

According to the first to the fourth representative embodiments, a canister is not incorporated to the fuel tank 1. However, a canister may be provided for communicating with the fuel tank 1. In this case, although a canister communicates with the external atmosphere, a change of the internal pressure of the fuel tank 1 is preferentially controlled by the adsorption/desorption device 12 that is communicated to the pump 13. Therefore, even in the case that the canister is provided, fuel components within vapor will not escape into the external atmosphere because the canister merely perform a subsidiary function.

Further, the pressure regulating valve 20 as disclosed in the second to the fourth representative embodiments may be an electric valve, which can control a valve opening amount. In this case, the pressure regulating valve 20 is opened when the pump 13 is stopped and the inside of the adsorption/desorption device 12 can be maintained to be a high negative pressure condition. When vapor is pressure-fed by the pump 13, the pressure regulating valve 20 is opened by a proper amount so that the vapor circulates within the vapor passage 10. Opening and closing of the pressure regulating valve 20 may be controlled by a controller.

This invention claims:

1. An apparatus for controlling an internal pressure of a fuel tank comprising:

an adsorption/desorption device capable of selectively absorbing or desorbing air components within vapor; and a vapor passage for communicating the adsorption/desorption device with an upper space within the fuel tank;

wherein the adsorption/desorption device and the vapor passage do not communicate with the external atmosphere;

a pressure detecting device for detecting the internal pressure of the fuel tank; and a pressure regulating device in the vapor passage disposed between the fuel tank and the adsorption/desorption device for controlling and maintaining the pressure applied to the adsorption/desorption device, wherein the pressure regulating device comprises a dual-direction pump capable of producing a gaseous stream in a first direction from the fuel tank toward the adsorption/desorption device and a gaseous stream in a second direction from the adsorption/desorption device toward the fuel tank opposite to the first direction;

a controller causing the pump to pressure-feed the vapor in the first direction until the internal pressure of the fuel tank is in equilibrium with atmospheric pressure, such that a part of air components contained in the vapor and corresponding to pressure that exceed atmospheric pressure is adsorbed by the adsorption/desorption device when the pressure detecting device detects that the internal pressure of the fuel tank is higher than the atmospheric pressure; and the controller causing the pump to pressure-feed the vapor in the second direction until the internal pressure of the fuel tank is in equilibrium with atmospheric pressure, such that an amount of air components corresponding to a pressure less than atmospheric pressure is desorbed from the adsorption/desorption device when the pressure detecting device detects that the internal pressure of the fuel tank is lower than atmospheric pressure.

2. The apparatus as in claim 1, wherein the vapor passage is configured as a circulation channel that introduces the vapor within the fuel tank from one opening into the adsorption/desorption device and returns the vapor that has passed through the adsorption/desorption device from the another opening into the fuel tank.

3. The apparatus as in claim 2, wherein a pressure regulating valve is provided in the vapor passage on the opposite side to the pump with respect to the adsorption/desorption device.

4. The apparatus as in claim 1, further including a temperature regulating device for controlling the temperature within the adsorption/desorption device; and wherein the temperature regulating device cools the inside of the device when the device adsorbs the air components within the vapor, and the temperature regulating device heats the inside of the device when the device desorbs the air components captured by the device.

5. The apparatus as in claim 1, wherein a temperature detecting device is positioned on at least one of the fuel tank, the adsorption/desorption device and the vapor passage for detecting the internal temperature.

6. The apparatus as in claim 1, wherein the adsorption/desorption device includes a porous material having pores and capable of selectively adsorbing or desorbing some air components.

* * * * *